US005931154A

United States Patent [19]

Hussong et al.

[11] Patent Number: 5,931,154

[45] Date of Patent: Aug. 3, 1999

[54] GAS FIREPLACE BURNER PLATE

[75] Inventors: Dudley D. Hussong, Lakefield, Minn.; Dennis Laabs, Spirit Lake, Iowa

[73] Assignee: Hussong Manufacturing Co., Inc., Lakefield, Minn.

[21] Appl. No.: 09/094,897

[22] Filed: Jun. 15, 1998

Related U.S. Application Data

[60] Provisional application No. 60/083,221, Apr. 27, 1998.

[51] Int. Cl.[6] ..... F24C 3/00

[52] U.S. Cl. ..... 126/512; 126/92 R; 126/92 AC; 431/125

[58] Field of Search ..... 126/512, 92 R, 126/92 A, 92 AC, 503, 92 B; 131/125, 126, 328, 329

[56] References Cited

U.S. PATENT DOCUMENTS 4,869,664 9/1989 Wright et al. ..... 126/92 R
5,479,916 1/1996 Shimek et al. ..... 126/512
5,671,727 9/1997 Squires et al. ..... 431/125

FOREIGN PATENT DOCUMENTS 2654194 5/1991 France ..... 126/512

*Primary Examiner*—James C. Yeung
*Attorney, Agent, or Firm*—Westman, Champlin & Kelly, P.A.

[57] ABSTRACT

A burner for a gas fireplace has a burner tube with a plurality of gas ports that provide flames for combustion when the burner is operating. A plate is positioned above the burner tube and has apertures that align with the ports of the tube such that flame passes through the apertures and causes the plate to heat along the aperture preferably to a red heat. The burner tube is spaced from but close to the plate to provide for secondary combustion air to pass between the burner and the plate and out through the apertures. The apertures are elongated slots formed in a serpentine fashion so that, when the plate is glowing with a red heat and used in connection with artificial logs there is realistic appearance of real wood burning and there is efficient combustion.

15 Claims, 4 Drawing Sheets

GAS FIREPLACE BURNER PLATE

CROSS REFERENCE TO RELATED APPLICATION

This application claims priority on prior copending U.S. provisional application Ser. No. 60/083,221, filed Apr. 27, 1998.

BACKGROUND OF THE INVENTION

The present invention relates to a burner for use in gas fireplaces, which has an overlying plate that provides efficient burning and decorative effects.

Burners in gas fireplaces generally are used in connection with artificial logs to provide a realistic glowing ember effect. The positioning of the burner tube will not only affect the flame appearance, but also can affect the amount of carbon monoxide that may be produced because of inefficient combustion.

Some manufacturers have positioned loose particle materials, such as mineral wool, around the burner ports to get a glowing effect, but this method also tends to increase carbon monoxide emissions or concentration in the burning gasses. The loose particle material used is generally small particle size, which causes it to fall into burner ports over a period of time. This results in reduced burner output. The loose material used is also very difficult to move around if adjustments need to be made on the burner. Also loose material needs to be replaced from time to time because of deterioration.

SUMMARY OF THE INVENTION

The present invention relates to a burner assembly, for a gas burner, usually in a fireplace, which has a burner board pan or plate made of metal that overlies the burner tube and the burner gas ports in the burner tube. Apertures are provided in the metal plate over the burner ports, and the heat from the burner gas coming from the posts will cause the metal burner plate to heat up to a red heat and glow when the burner is active. By placing ceramic or other material artificial logs on the plate with the log edges adjacent the apertures in the burner plate, the heat also causes the artificial logs to glow red to give a natural glowing ember effect. Spacing the burner plate from the burner output openings by a small amount permits secondary combustion air to mix with the fuel gas at the point of ignition, which is just slightly spaced from the exit end of the burner ports, to cause more efficient burning.

The metal burner plate is made of material such as aluminized steel to prevent rust, and is of sufficient thickness to prevent warpage or deterioration from heat. A "red heat" temperature of the metal is a recognized condition where the metal glows red, but does not melt.

Thus, highly efficient burning results by having a metal plate that has apertures letting flames rise through them and which will heat up to a red glow when the burner is in operation. This causes very efficient burning. The apertures, as shown, slots through which the heated gasses from combustion pass, cause edges of the apertures to heat up so adjacent portions of the plate reach red heat and glow and the artificial logs also heat up and glow to provide a very attractive appearance.

DETAILED DESCRIPTION OF THE PREFERRED EMBODIMENTS

Figure 1:
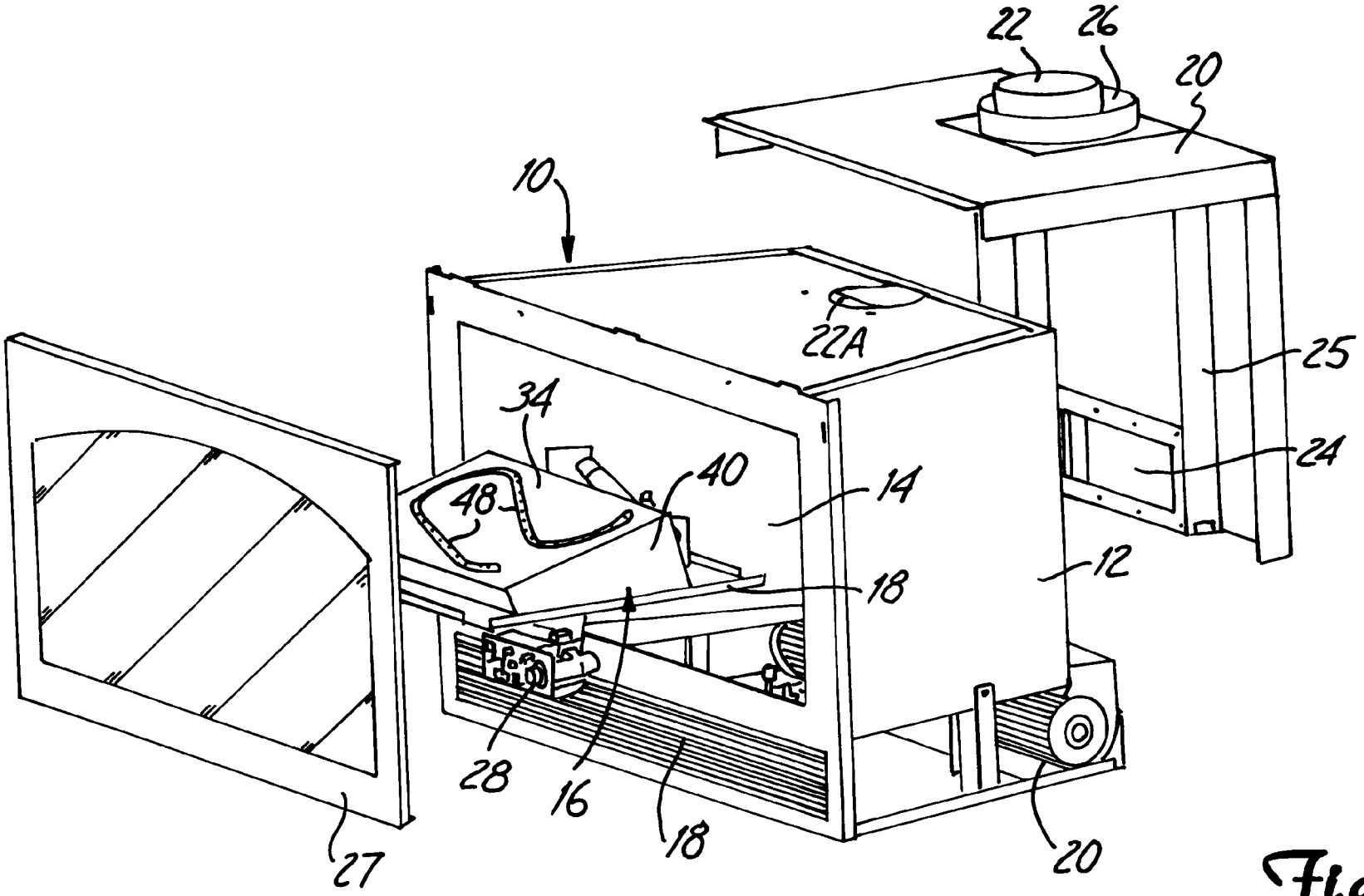
FIG. 1 is a schematic exploded view of a typical gas burner fireplace insert utilizing a metal burner plate made according to the present invention.

A typical gas fireplace insert shown generally at 10 is shown in exploded view for purposes of illustration, and includes an outer housing 12 that forms an interior burner chamber 14. The burner chamber 14 houses a burner assembly 16 in a normal manner mounted on a base wall 18 of the fireplace insert. The base wall 18 is the bottom wall of the combustion chamber. A duct assembly 20 can be placed over the housing 12 and provides an outlet for a chimney 22 leading from a hot gas outlet port 22A and a fresh air intake port 24 that takes air in from an annular passageway 26 around the chimney connected to duct 25, shown schematically.

Figure 2:
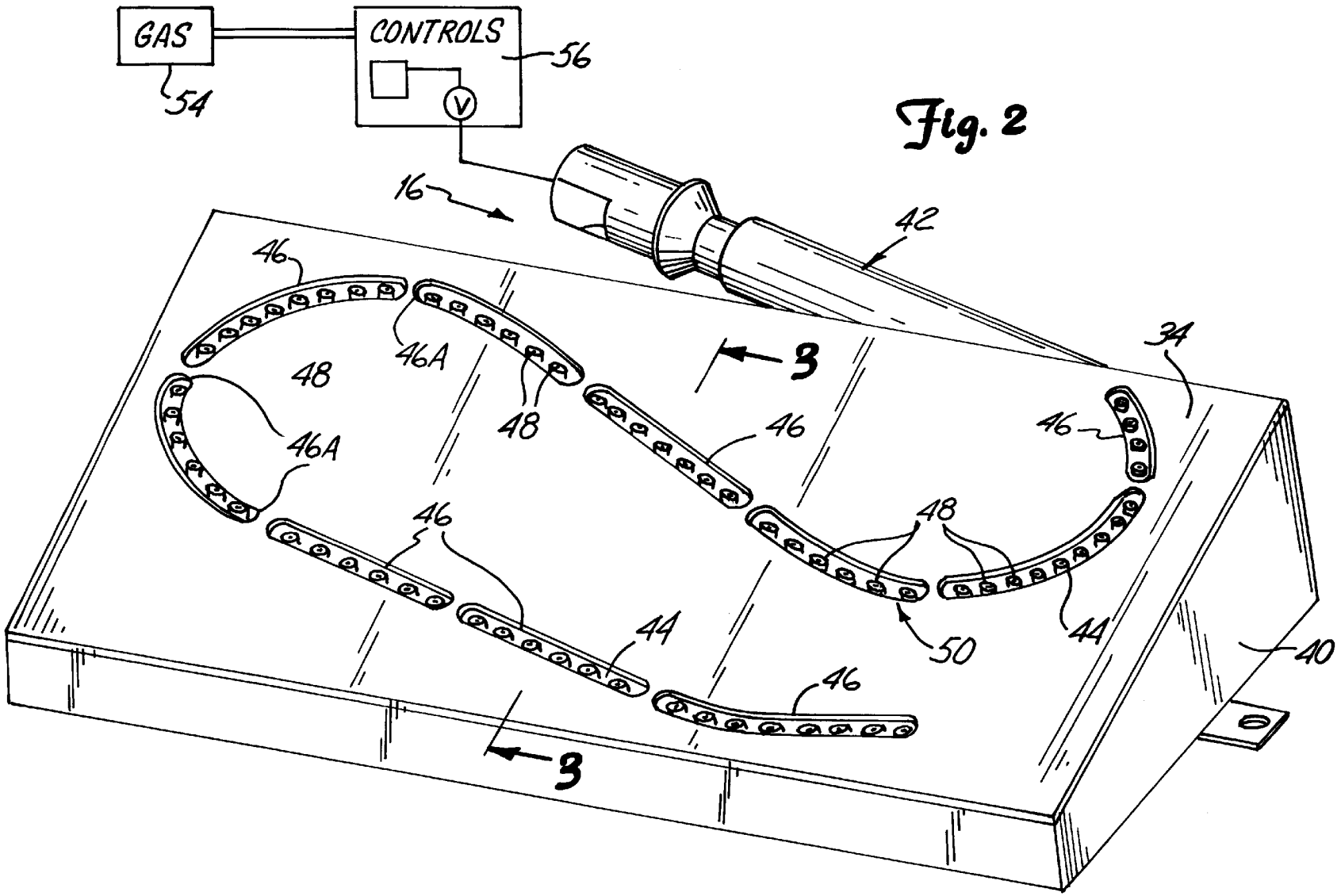
FIG. 2 is a perspective view of the burner plate of the present invention.

The gas fireplace insert 10 can be provided with room heating ducts leading from an inlet grill 18 through a fan 20 and then out through the ducts out through the top of the housing in a usual manner. A front wall with a glass cover is shown at 27 and is used to cover the front opening of the fireplace insert in a normal manner. Suitable burner and fan controls 28 are also provided. Many different gas fireplaces have been advanced, so the showing is only schematic. The burner assembly 16 of the present invention will work with any type of gas fireplace. The burner assembly is shown in more detail in FIGS. 2 and 3, and as shown, the burner assembly comprises a metal burner plate 34 that is supported on a front wall 36, and tapered side walls 40 (see FIG. 3) so that the burner plate 34 is inclined slightly upwardly toward the rear for greater visibility of artificial logs shown at 38 that are supported on the burner plate 34. The side walls are spaced apart and provide an open back to permit the intake combustion airflow in easily. The side walls 40 enclose the sides of the space below the burner plates and form a chamber 41. A burner tube assembly 42 is mounted in chamber 41 on suitable supports. The burner tube assembly 42 has a burner tube section 44 that includes burner ports 46. A controlled gas source is connected to one end of the burner tube section through standard controls, and the other end of the burner tube is closed.

The metal burner plate 34 has a series of apertures or slots 46 that are shown in a generally curved pattern 50 that is desired for providing a flame pattern from the outlet ports 48 at desired locations. The burner tube 44 can be of any substantially conventional design that carries gas from a source 54 through suitable controls 56 such as a millivolt board, a thermostat, and a gas valve as needed to provide gas to the inlet end of the burner tube assembly 42. Gas from the source 54 exits out through the ports 48. A suitable pilot light or automatic ignitor is used in connection with the controls 56, so combustion of the gas from the source occurs at the outlet ports 48.

Figure 3:
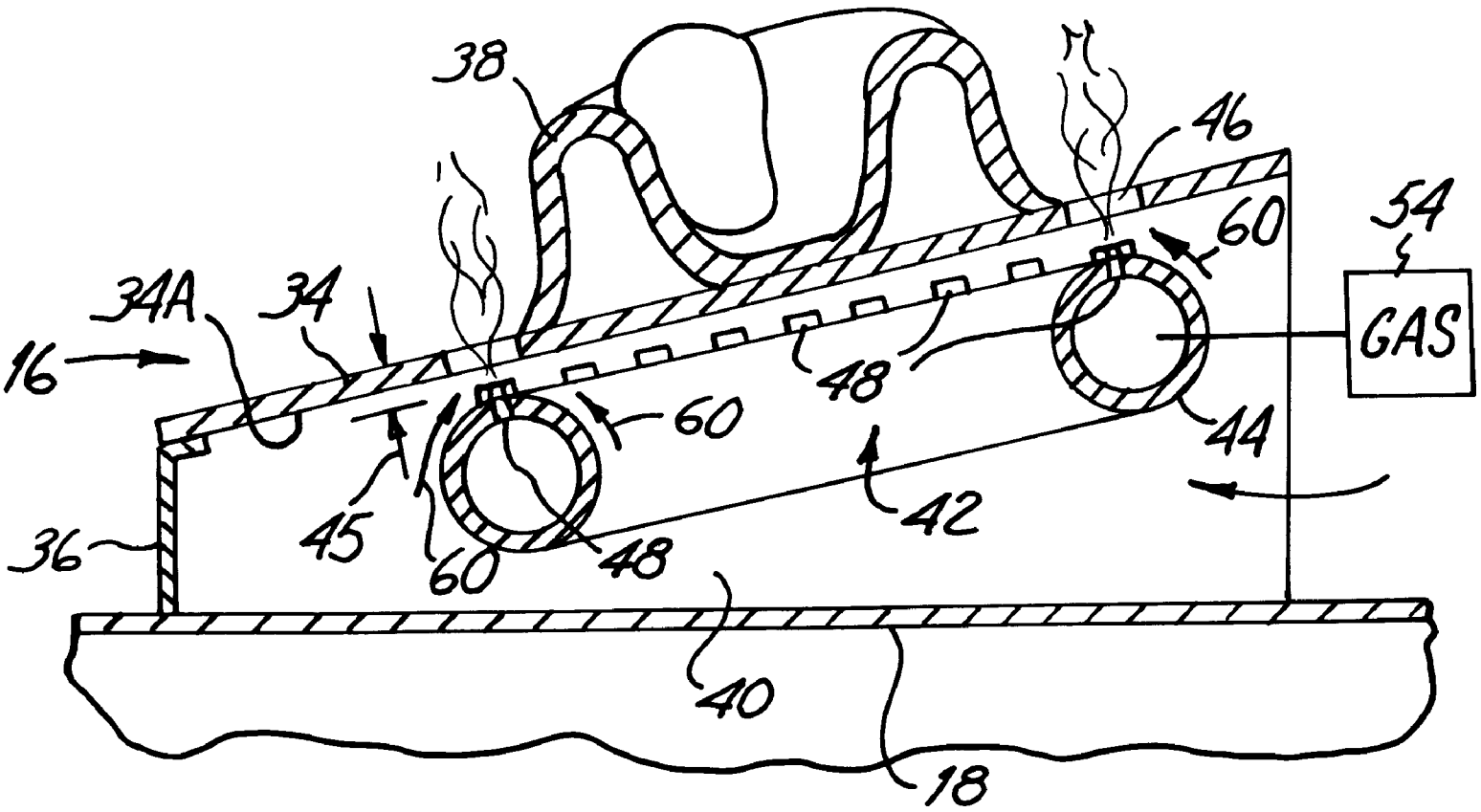
FIG. 3 is a sectional view taken as on line 3—3 in FIG. 2, with typical artificial logs shown schematically in connection with the burner.

The plate 34 is a metal plate, and as can be seen, the bottom surface shown at 34A is spaced from the top of the burner tube by a distance schematically shown at 45. Combustion air is admitted into chamber 41 from the open back and air will pass between the top of the burner tube and the under surface 36A of plate 36, as shown by the arrows 60, to provide secondary combustion air. The flames then pass up through the slots 46, as shown in FIG. 3, and will contact the edges of the slots and the artificial ceramic logs 38 so that the flames would tend to heat the edges and cause the logs to glow. Also, the heat from the burner tube is sufficiently high so that the metal plate 34 will reach red heat temperature and will actually glow red, providing a warm glow in the interior of the fireplace and causing the logs to glow in a realistic manner. The flames will lick up around the logs 38 as well, as is common in gas fireplaces using artificial logs.

Figure 4:
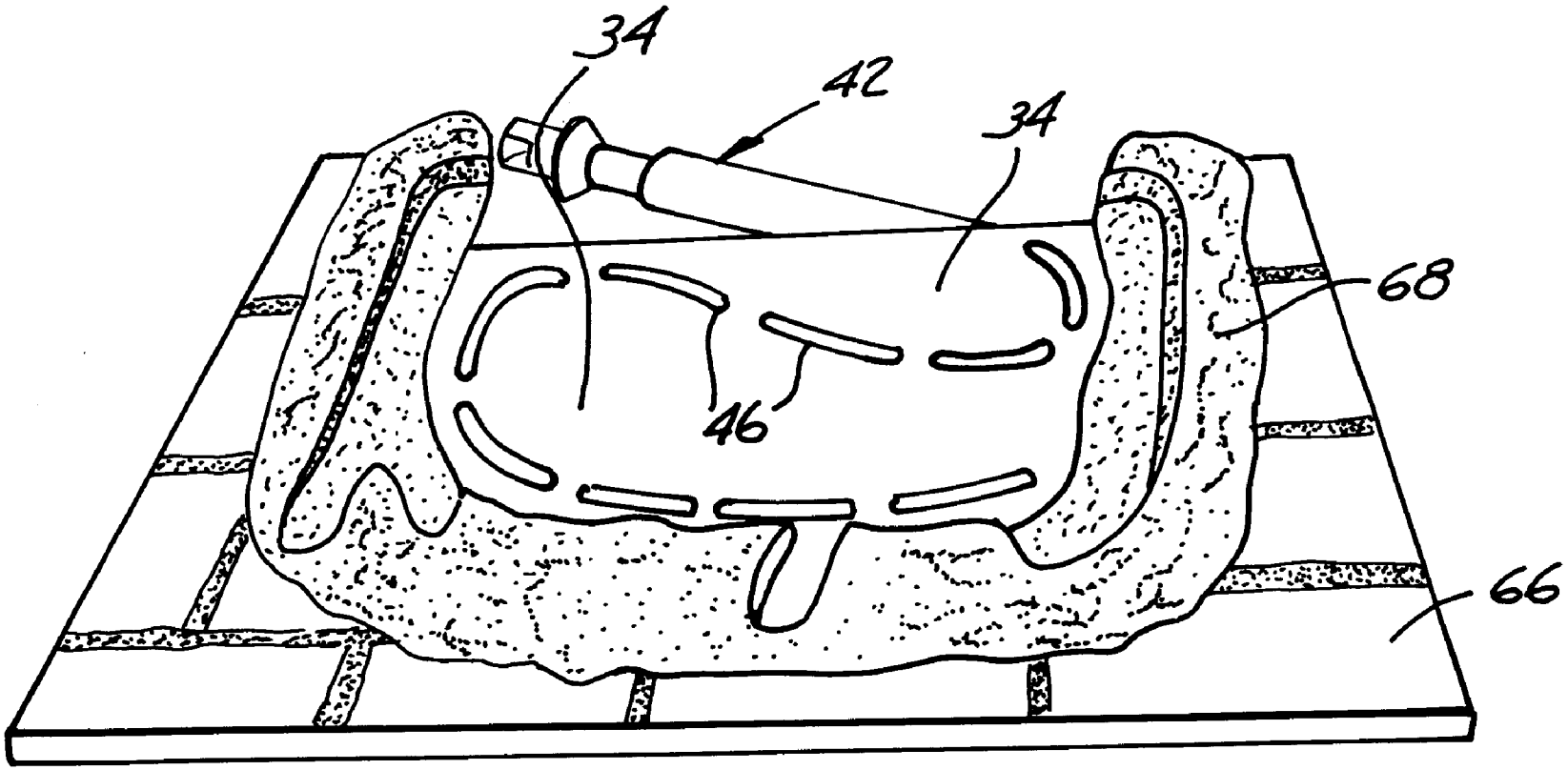
FIG. 4 is a perspective view of a typical refractory base on top of the burner plate made according to the present invention.

As shown in FIG. 4, a refractory material overlay 66 can be supported on the plate 34 and include a bed 68 made to receive the artificial logs 38 in some desired configuration, so that the entire plate 34 would not be exposed to the viewer when the burner is operating.

The length of the slots 46 can be varied, and usually they will be of a length so that the strength of the plate is not adversely affected by having a long slot in it. The cross members shown at 46A between slot sections 46 are used primarily for strength purposes. The slots can be replaced by a series of holes that would be larger than the ports 48 in the burner tube 44, so that the flames would come up through the holes and around the edges of the holes, to cause the plate 34 to heat up and glow red.

Thus, by choosing the correct material so that it does not deteriorate under heat and oxygen, and will glow red, efficiency is improved and appearance is greatly improved by having higher heat content at the artificial logs, which may be ceramic material logs.

Although the present invention has been described with reference to preferred embodiments, workers skilled in the art will recognize that changes may be made in form and detail without departing from the spirit and scope of the invention.

What is claimed is:

1. A burner for a gas fireplace comprising a burner tube having a length and a plurality of gas ports therein, a metal plate overlying said burner tube and spaced closely therefrom, said metal plate having apertures aligning with a substantial number of the gas ports in the burner tube, the apertures being of size and spaced from the burner tube a distance so that flame from burning gas coming through the ports contacts and heats the metal plate at the edges of the apertures.

2. The burner of claim 1, wherein the apertures are of size such that flame passes through the apertures and heats edges of the apertures sufficiently to obtain a red heat in at least a portion of the metal plate.

3. The burner of claim 1, wherein said metal plate is inclined from a forward end of the plate to a rear end of the plate, and has side walls defining a passage for secondary air to enter below the metal plate and pass through the apertures in the metal plate.

4. The burner of claim 2, wherein the burner tube is spaced below a lower surface of said burner plate sufficiently to permit air to flow through the apertures along with burning gases.

5. The burner of claim 1, wherein said apertures are formed as elongated slots in a selected pattern on the metal plate.

6. The burner of claim 5, wherein there are a plurality of webs that span the slots in selected portions along the length of the slots.

7. The burner of claim 1, wherein said burner plate is made of aluminized steel.

8. The burner of claim 1 and a plurality of ceramic fiber logs mounted on an upper side of said plate, the fiber logs having edges overlapping at least portions of the apertures in the burner plate.

9. The burner of claim 8 and a mineral fiber panel overlying at least portions of said burner plate and leaving the apertures exposed.

10. A gas fireplace comprising a base wall, a burner assembly supported inside a combustion chamber, the burner assembly including a burner housing having a side wall, a front wall and a burner plate forming a top wall, the burner housing defining a chamber below the burner plate, and a burner tube positioned in the chamber below the burner plate and extending laterally along portions of the burner plate, the burner tube providing gas flames from an upper side of the burner tube, and a series of apertures in the burner plate overlying the burner tube of size and spaced closely above the burner tube such that when the burner tube is providing gas flames such flames pass through the apertures and heat the burner plate to a red heat along the apertures.

11. The fireplace of claim 10, wherein said apertures are elongated slots.

12. The fireplace of claim 10, wherein said slots extend laterally of the fireplace, and form at least two lengths extending laterally of the fireplace in a serpentine shape.

13. The fireplace of claim 10, wherein said burner tube has a plurality of gas ports therein on an upper side of the burner tube.

14. A method of providing a visual glow to a gas fireplace insert comprising the step of providing a gas burner producing flames in a narrow elongated path, overlying the gas burner with a metal plate having apertures positioned above the elongated path of flames, providing secondary air through the apertures and positioning the edges of the apertures such that flames pass therethrough and heat such edges to a red heat.

15. The method of claim 14 including the step of providing fiber logs on the plate positioned to be heated by flames passing through the apertures.

* * * * *